US005575069A

United States Patent [19]

Roberto Kneeland

[11] Patent Number: 5,575,069

[45] Date of Patent: Nov. 19, 1996

[54] PIVOTABLE HAIR CUTTING DEVICE FOR CUTTING OVER NON-LINEAR SURFACES

[76] Inventor: Katherine R. Roberto Kneeland, 113 Fairmount Ave., Saugus, Mass. 01906

[21] Appl. No.: 276,160

[22] Filed: Jun. 28, 1994

[51] Int. Cl.[6] ..... B26B 19/02

[52] U.S. Cl. ..... 30/199; 30/225

[58] Field of Search ..... 30/195, 208–214, 30/223–225, 199

[56] References Cited

U.S. PATENT DOCUMENTS

| | | | |
|---|---|---|---|
| 532,188 | 1/1895 | Shannon | 30/199 |
| 1,805,323 | 5/1931 | Young | 30/225 |
| 4,094,065 | 6/1978 | Geary | 30/210 |
| 4,214,365 | 7/1980 | Walter | 30/224 |
| 4,867,184 | 9/1989 | Davis | 132/214 |
| 5,054,199 | 10/1991 | Ogawa et al. | 30/34.1 |
| 5,075,971 | 12/1991 | McCambridge | 30/133 |

*Primary Examiner*—Douglas D. Watts
*Attorney, Agent, or Firm*—Christopher Ricci

[57] ABSTRACT

A removable and replacable hair cutting head for use with motorized hair cutting tools. The hair cutting head adapts to conventional motorized hair cutting tool bodies allowing the head to pivot with a resistive bias through a limited range of angular motion. The cutting head itself has a non-linear array of cutting teeth for shearing hair over a non-linear surface. In the preferred embodiment, the cutting head has a longitudinal axis and is concave with respect to the longitudinal axis.

12 Claims, 4 Drawing Sheets

PIVOTABLE HAIR CUTTING DEVICE FOR CUTTING OVER NON-LINEAR SURFACES

BACKGROUND OF THE INVENTION

The present invention relates generally to hair cutting tools, and, more particularly, the invention relates to removable and replaceable actuatable cutting heads for electric hair cutting devices for use on a human head where the cutting head is non-linear and pivotable.

Conventional electric hair cutting devices have an electrically motorized body and a cutting head. The cutting head is fixed with respect to angular motion and has a straight cutting surface. The cutting head attaches to the motor such that a reciprocating pin on the motor drives a lower blade on the cutting head against a fixed upper blade. A hair that is then placed in contact with the cutting head is sheared between the two blades.

While conventional hair cutting devices do cut hair as intended, such systems do have certain limitations. For example, hair is generally found on non-linear surfaces such as the human head. The straight blades of the conventional system make only a portion of the blades usable when pressed directly against the human head. Faced with this problem, hair stylists often pull the hair away from the human such that only one end of the head is being used. Both of these procedures involve putting sharp points against the side of a head which can cause injury if the subject moves even the slightest amount.

This same danger also exists if the electric cutter is being used to cut a straight line and the user is holding the cutter at an angle to the head. The angle will cause the end point of the cutting head to gouge the subject leading to a possible injury.

Accordingly, it is an object of this invention to increase the usable area of the cutting head over a non-linear surface.

It is another object of this invention to provide a device that simplifies cutting hair in a curved design.

It is still another object of the invention to provide a safer cutting tool that is more adaptable to a cutting surface.

These and other objects of the invention will be obvious and will appear hereinafter.

SUMMARY

The aforementioned and other objects are achieved by the invention which provides, in one aspect, a hair cutting tool. The invention provides an extremely versatile tool for cutting hair on a human head, or other surface containing hair. The system comprises a drive means and a cutting means.

The drive means generates a drive force to power the hair cutting device. Often it is in the form of an elongate housing containing a motor. The motor drives a dive peg in a reciprocating motion to communicate the drive force axially from the drive means.

The cutting means receives the drive peg and is actuatable by the drive force. The cutting means itself has a plurality of cutting edges reciprocating in shearing engagement, where each cutting edge has a non-linear array of cutting teeth for cutting hair that comes in contact with the cutting teeth. In the preferred form, the cutting means has a longitudinal axis and the non-linear array of cutting teeth are arced along said longitudinal axis relative to a centrally located axis.

The cutting means is removably and replacably attachable to said drive means such that it can be used with conventional hair clipper bodies. The cutting means is made up of a stationary blade and a reciprocating blade. The stationary blade has a central pivot point to allowing angular motion with respect to the drive means. The angular motion of said stationary blade is mechanically limited to an angle of ±10° in the preferred embodiment. In some instances a user may wish to lock the pivoting motion of the blades and, therefore, a push-pin is provided to fix the blades angular motion with respect to the drive means.

The reciprocating blade is secured to the stationary blade such that the reciprocating blade is pivotable with the stationary blade. At the same time, the reciprocation blade is in communication with the drive means such that the reciprocating blade is driven in a reciprocating motion relative to the stationary blade.

Another aspect of the blades is that the stationary blade has teeth of a first length and said reciprocating blade has teeth of a second length where the first length exceeds the second length.

In further aspects, the invention provides methods in accord with the apparatus described above. The aforementioned and other aspects of the invention are evident in the drawings and in the description that follows.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION

While the present invention retains utility within a wide variety of hair cutting devices and may be embodied in several different forms, it is advantageously employed in connection with a clipper for cutting hair on a human head. Though this is the form of the preferred embodiment and will be described as such, this embodiment should be considered illustrative and not restrictive.

The invention is useful with a body supplying a drive force which is designed for use with the invention or is adaptable to any of various commercially available bodies for conventional cutting tools.

The invention seeks to accommodate cutting non-linear cuts by allowing the cutting head of the tool to pivot about a central point with a limited allowable angular movement. Additionally, the blade of the cutting head is non-linear to conform more closely to the non-linear surfaces upon which the hair is found.

Figure 1:
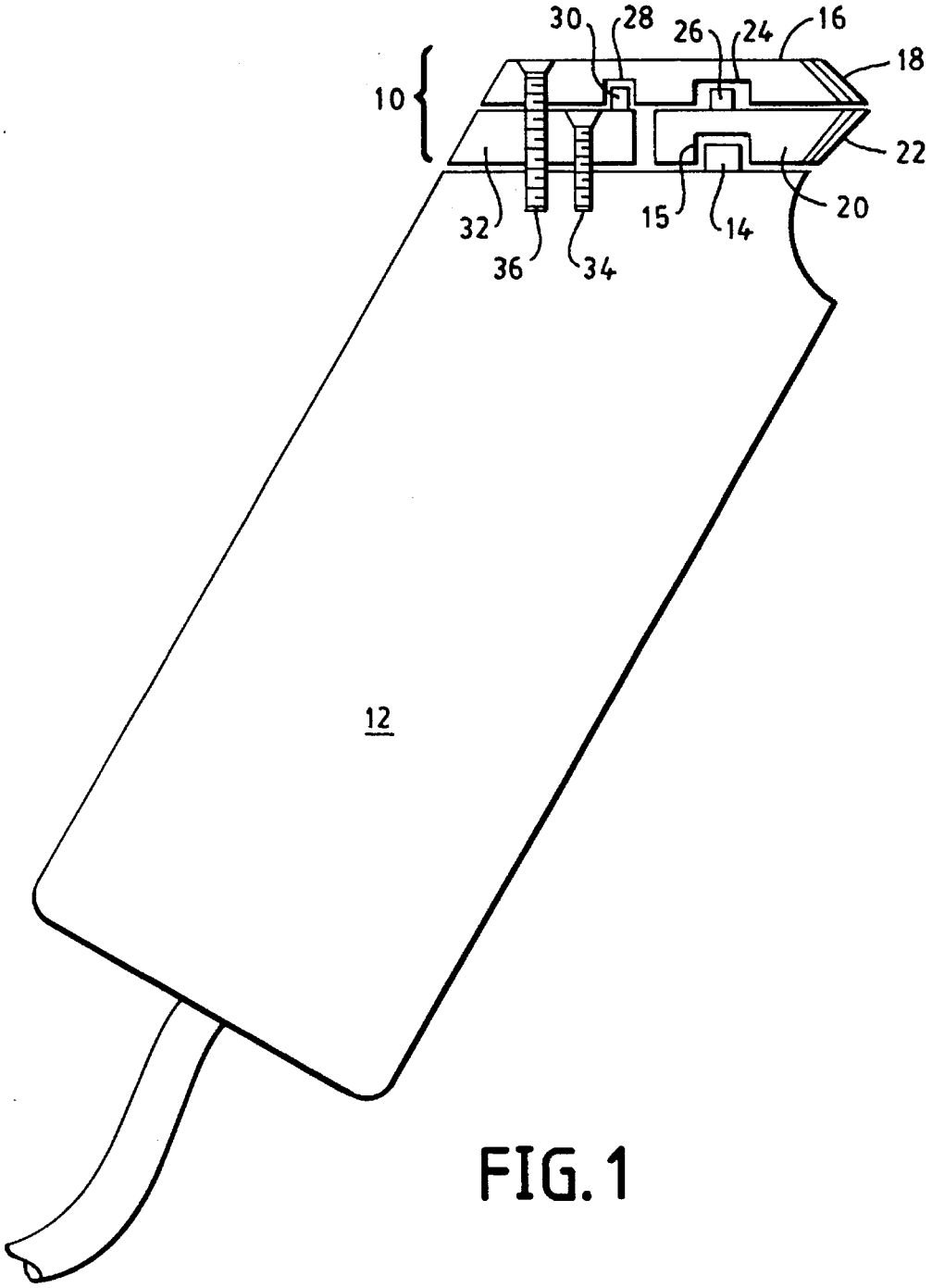
FIG. 1 shows a schematic diagram of a hair cutting tool in accordance with the invention.

FIG. 1 is a diagram of an assembled hair cutting tool according to the invention. The tool will be discussed as having two sections: a body 12 and a head 10. The body 12 contains a drive mechanism which actuates the head 10 via a drive peg. The drive mechanism may be any of various devices, including a common electric motor (as depicted) or manually operated drive mechanism, but the drive mechanism will be referred to generally as the motor.

The motor actuates the head 10 by communicating a drive force through the drive peg 14. The drive peg is reciprocally driven along an axis transverse to the plane of the drawing and along a cutting axis parallel to the cutting teeth of the head. In the preferred embodiment, the reciprocating motion of the drive peg is generated by a buzzer-type motor commonly known in the art or a rotary motor for quieter operation where the rotor motion is converted to linear motion by an eccentric and an eccentric cam as commonly known in the art.

The reciprocating motion of the drive peg in this embodiment is pendulum-like in that the drive-peg follows a curve of substantially the same radius as the curve of the cutting surfaces.

The head is made up of three sections: a lower cutting plate 20, a spacer plate 32, and an upper cutting plate 16. The lower cutting plate is connected to the drive peg 14 and is driven in a reciprocating motion along the cutting axis by the drive peg. On a top surface of the lower cutting plate and extending vertically are multiple track pegs 26. As the lower cutting plate 20 moves, the track peg follows a curved track 24 in the upper cutting plate forcing the lower cutting plate 20 to follow a curved path ensuring that the teeth of the lower cutting plate follow the teeth of the upper cutting plate 16.

The spacer plate is located to the rear of the lower cutting plate and is fixed against a top surface of the body 12. In a forward area of the spacer plate 32 there is a pivot peg that extends vertically into a pivot recess in the upper cutting plate 16 for restricting a pivot motion of the upper cutting plate 16.

The upper cutting plate 16 is pivotably attached through the spacer plate 32 to the body 12 allowing the upper cutting plate 16 and the lower cutting plate 20 to have a limited angular movement with respect to the body 12. The limit of the angular movement is provided by the length of the angular recess 28 such that as the head pivots about the pivot screw 36 the pivot peg remains stationary thereby stopping pivoting motion when it strikes the end of the pivot recess 28.

Cutting by the curved cutting teeth is accomplished when the hair is placed between the teeth 18, 22 and the reciprocating motion of the drive pin causes the lower cutting plate 20 to slide along the stationary upper cutting plate severing the hair with a scissor-like action.

Figure 2:
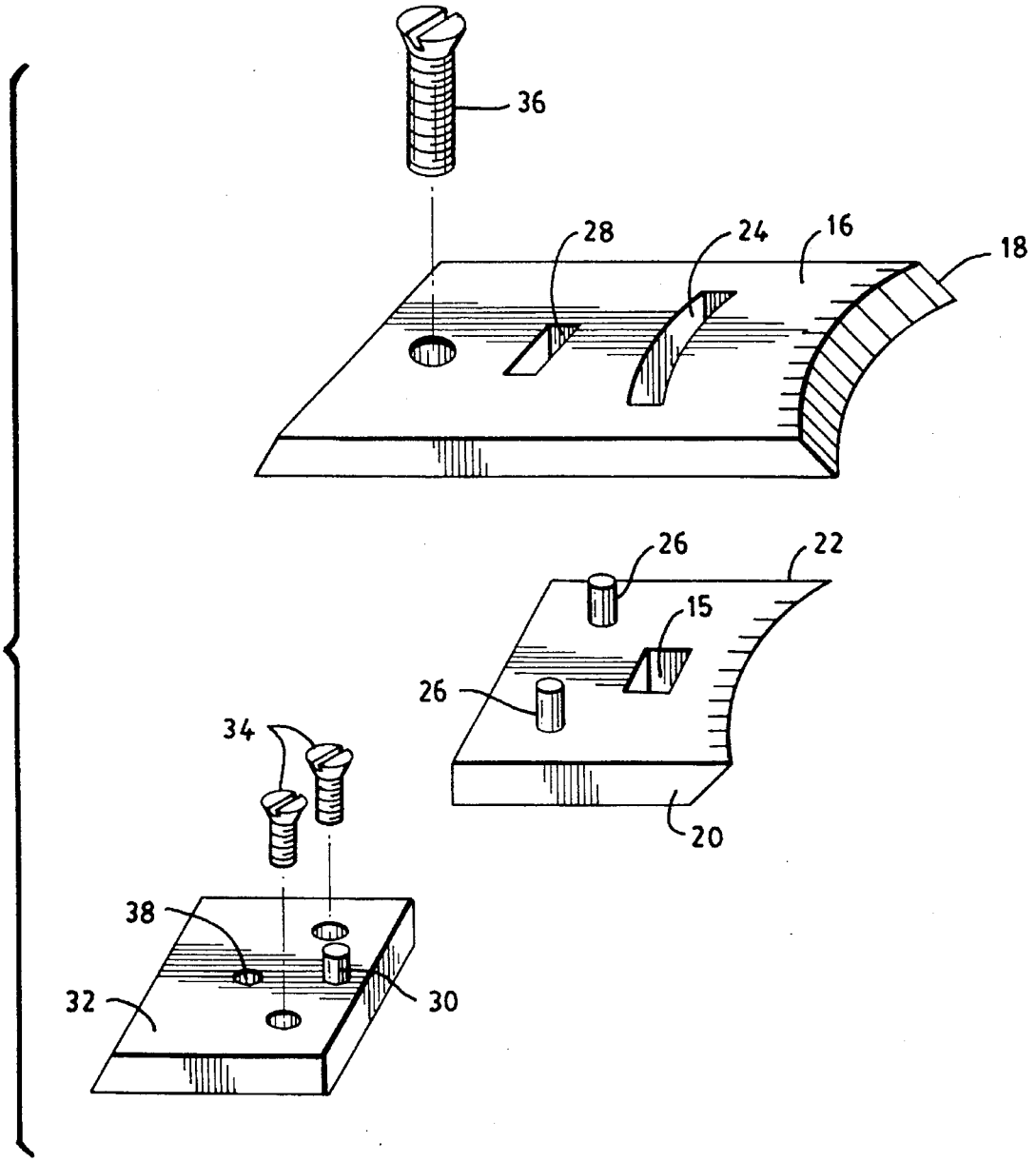
FIG. 2 shows an exploded view of the cutting head of the hair cutting tool of FIG. 1.

FIG. 2 shows an exploded view of the cutting head as previously described. In this illustration the curved nature of the cutting teeth 18, 22 is readily seen. In the preferred embodiment, the radius of the curve of the teeth and the curved track approximate the curve of an average human head.

The interconnections between the various sections of the cutting head 10 are brought forward by this drawing. The spacer plate 32 is fixed to the body 12 by a plurality of screws 34. Also in this plate is illustrated a tapped pivot hole 38 into which the pivot screw 36 will be threaded. The pivot peg 30 extends vertically from the spacer plate to interconnect with the upper cutting plate 16.

The lower cutting plate 20 is placed in front of the spacer plate 32 with a non-linear array of cutting teeth 22 extending axially at a distal end. The non-linear array of cutting teeth 22 are concave providing a curved cutting edge. In the preferred embodiment, the teeth themselves are coated with one of the following hard carbon, low friction carbide, tungsten, a diamond coating or molybdenum-disulfide to increase resistance to wear and decrease maintenance.

The lower cutting plate sits over the drive peg previously described. The drive peg fits snugly into a drive slot 15. As the drive peg reciprocates along its curved path, the drive peg pushes against the sides of the drives slot communicating the drive force causing the lower cutting plate to reciprocate along the same path. Track pegs 26 extend vertically from the lower cutting plate into the curved track 24 further ensuring that the lower cutting plate follow the curved path. Additionally, the track pegs add lateral stability to the moving plate and reduce extraneous movements due to machining error or vibration.

The upper cutting plate 16 is secured by the pivot screw 36 allowing a limited pivot as previously discussed and otherwise being fixed with respect to the lower cutting plate.

There are numerous moving parts used in this invention which must be kept lubricated to ensure freedom of movement. Therefore, a lubricant must be chosen that is not susceptible to drying out and gumming and, therefore, will extend the time between cleanings. A lubricant with a low vapor pressure such as silicone oil may be used but such an oil tends to attract small particles.

In the preferred embodiment, a dry lubricant is used to lubricate for long-term use. TEPHLON, a trademark owned by E.I. Dupont De Nemours, Inc., may be used, but molybdenum-disulfide ($MoS_2$) is preferred due to the latter's ability to sustain in harsh environments. Therefore, at all frictional surfaces in the invention are coated with $MoS_2$ in the preferred embodiment.

Figure 3:
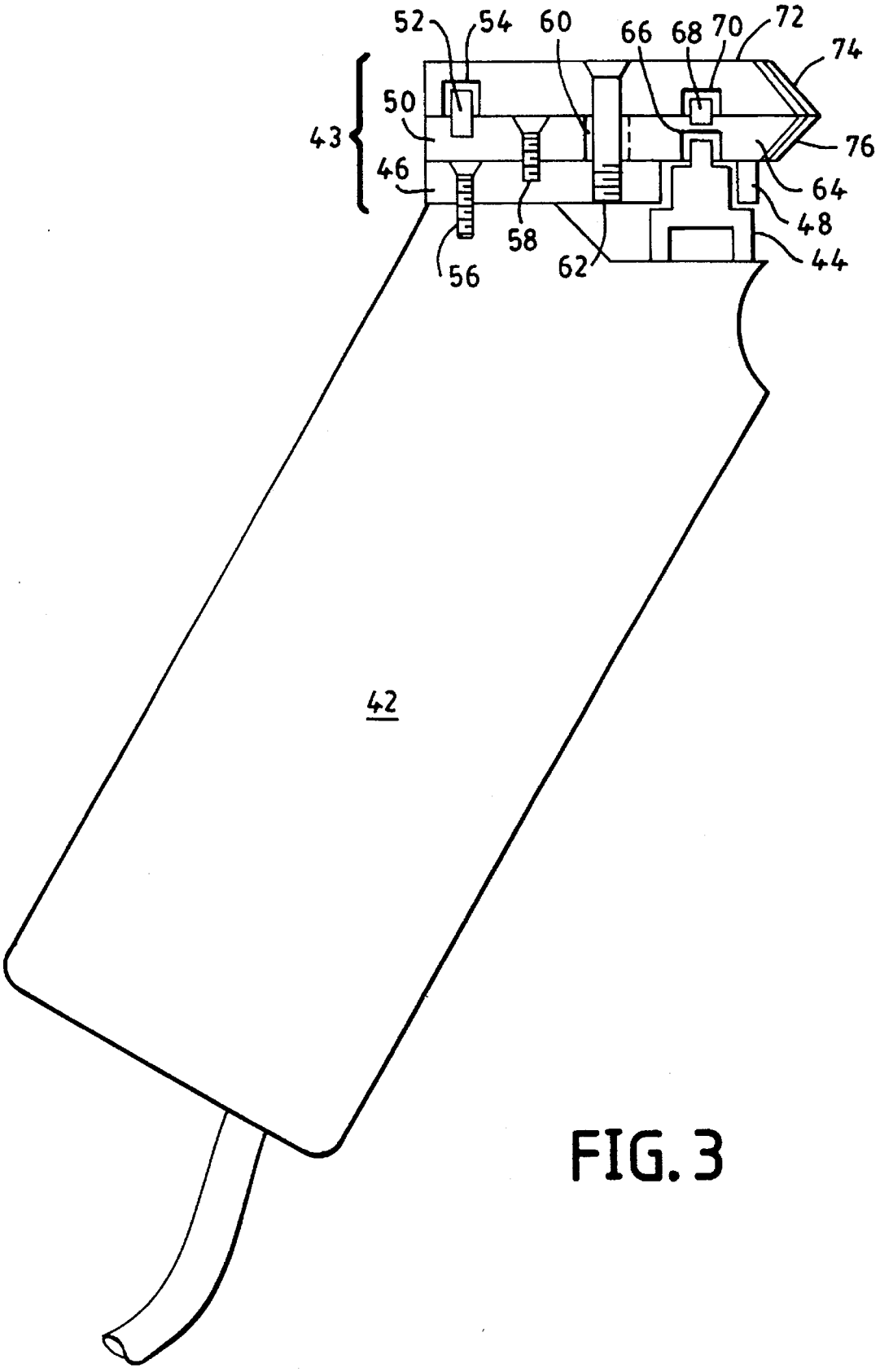
FIG. 3 shows a schematic diagram of a hair cutting tool with standard motorized body where the cutting head is built in accordance with the invention.

FIG. 3 illustrates a second embodiment of the invention where a conventional commercially available body is used and a cutting head designed in accordance with the invention. The cutting head adapts to the body to replace a conventional cutting head with which the body was supplied.

In this embodiment, an adapter plate 46 is attached to the motorized body to provide attachment points necessary for the pivoting motion of the cutting head. The adapter plate 46 is fabricated to be connected to the motorized housing 42 in a fixed position in the same way the conventional cutting head attached to the motorized body. In the illustrated example the way of attaching is two screws 56.

The adapter plate allows the driver 44, which communicates a drive force from the motor, to pass through the adapter plate without restriction and connect directly with the lower cutting plate 64.

Figure 4:
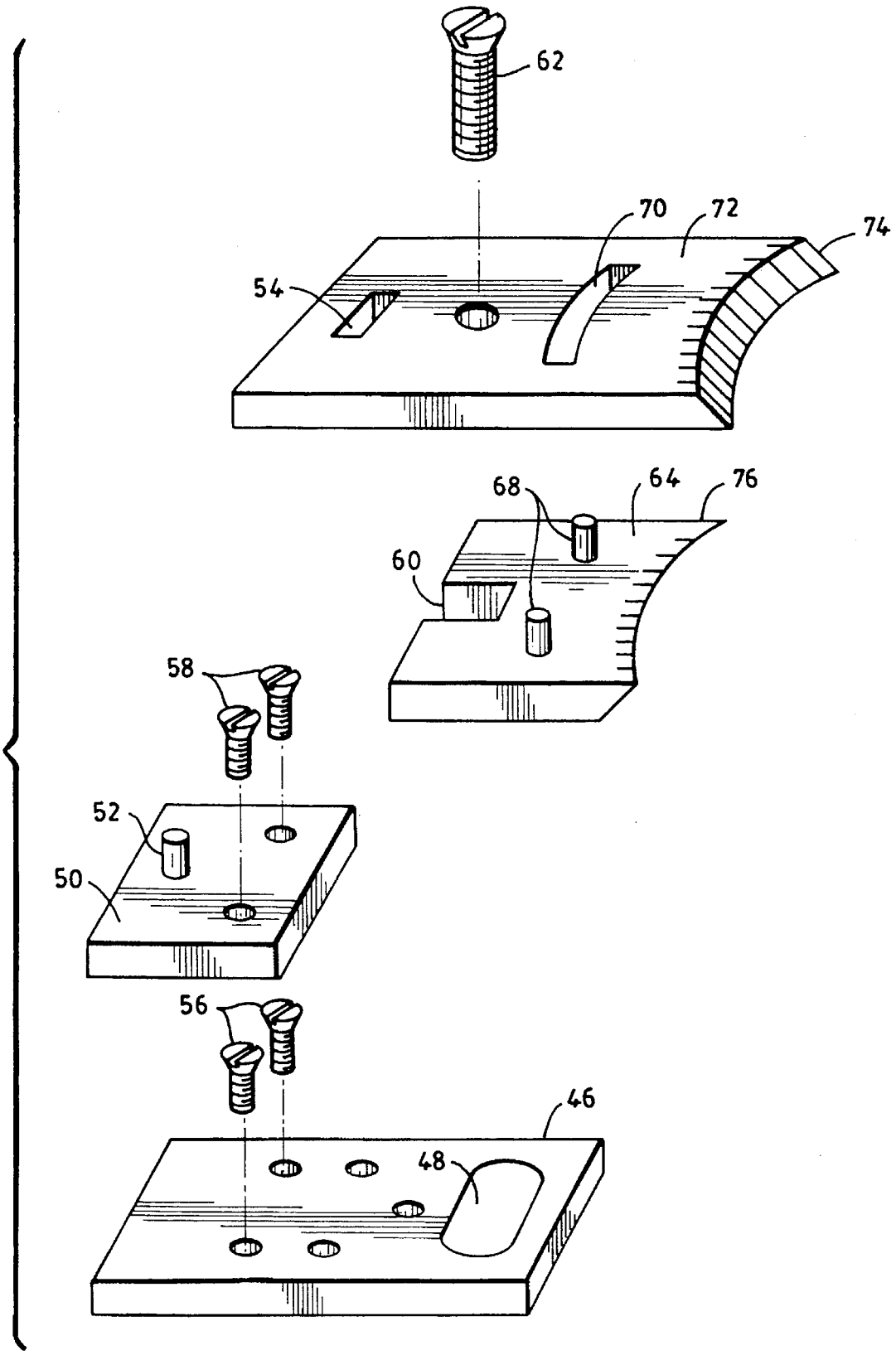
FIG. 4 shows an exploded view of the cutting head of the hair cutting tool of FIG. 3.

FIG. 4 illustrates the interconnection of the individual parts of the cutting head, inter alia. The adapter screws 56 secure the adapter plate 46 to the motorized body 42 while allowing the driver 44 to pass through a bore 48. Though this is the illustrated form of the adapter plate, numerous other methods of attachment and modifications of design may be employed to adapt the cutting head to various commercially available motorized bodies without departing from the inventive aspects of the invention.

A spacer plate 50 is attached to the top surface of the adapter plate 46 with spacer screws 58. The spacer screws are driven into threaded holes in the adapter plate to fix the spacer plate in position.

A lower cutting plate 64 is placed over the remaining portion of the adapter plate such that the lower cutting plate 64 overlaps the adapter plate 46 extending the lower teeth 76 outward.

The upper cutting plate 72 is then secured over the spacer plate 50 and the lower cutting plate 64. A single pivot screw passes through a hole in the upper cutting plate and through a slot 60 cut into the lower cutting plate into a threaded hole in the adapter plate. The hole in the upper cutting plate is unthreaded to accommodate free movement and may be lined with a bearing to further promote such movement. The slot 60 is wide so as not to hinder the reciprocating motion of the lower cutting plate.

Having been secured by the pivot screw 62 in such a way as to allow angular movement parallel to the plane of the adapter plate, the cutting head can now move with the contour of the surface over which it is cutting. The angular movement is restricted by a pivot pin 52 that extends vertically from the spacer plate 50 into a pivot bore 54 such that the head is restricted to a useful cutting range and the linear motion of the drive peg is not being forced to drive the cutting head at too great an angle to properly transfer the drive force. In the preferred embodiment, the angle is restricted to ±10°.

The sides of the pivot bore are lined with a foam rubber to bias the cutting head 43 toward a normally centered position while adding a steadily increasing bias away from sides. If necessary, opposing springs may also be used to increase to normally centered bias where the foam rubber pad would then be used for damping the pivot motion.

In either of the two embodiments, a push-pin (not shown) may be added to optionally fix the pivoting motion of the cutting head. The push-pin would normally be extended vertically from the upper cutting plate. If the user chose to fix the pivotability of the cutting head, downward force would be applied to the top of the push-pin forcing it to extend down through the upper cutting plate into the spacer plate of the adapter plate. Upon completion of the task requiring a fixed cutting head, the push-pin would be raised by the user pulling up on the push-pin or other ejection method commonly found in the art.

The upper teeth 74 extend outward over the lower cutting plate 64 and slightly beyond. The upper teeth themselves are longer than the lower cutting teeth 76 to avoid pulling hairs. It accomplishes this by allowing the upper cutting teeth to comb the hair into the lower cutting teeth where the hair is sheared by the reciprocating motion of the lower cutting teeth.

The upper cutting teeth 74 and the lower cutting teeth 76 are curved inward and concave with respect to a plane transverse to the pane of the adapter plate. The concave nature of the cutting teeth allow the cutting head to move over a nonlinear surface without gouging at the edges.

In an alternative embodiment (not shown), the curve of the teeth arcs creating a convex shape relative to the plane of the adapter plate. This curvature is useful in certain circumstances for cutting hair non-linearly around fixed objects, such as cutting the hair around an ear.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A cutting head for replacing a conventional cutting head on a motorized hair cutting tool, said motorized hair cutting tool having a distal end and a proximal end substantially opposed across a central axis and having an electric motor disposed therein to generate a drive force communicated through a drive peg in the distal end, said cutting head comprising cutting means in communication with said drive peg and actuatable by said drive force, said cutting means having a plurality of cutting blades with an oscillating cutting blade oscillating in shearing engagement with a stationary cutting blade and said plurality of cutting blades terminating with a non-linear array of cutting teeth for cutting hair that comes in contact with the cutting teeth, said cutting means being removably and replacably attachable to the motorized hair cutting tool such that the cutting means is free to pivot about the motorized hair cutting tool while cutting.

2. The cutting head according to claim 1 wherein said cutting means has a longitudinal axis substantially perpendicular to said central axis of the motorized hair cutting tool and said non-linear array of cutting teeth are arced along said longitudinal axis.

3. The cutting head according to claim 2 wherein the stationary blade has a pivot point for allowing angular motion with respect to the central axis of said motorized hair cutting tool and the reciprocating blade pivots along with said stationary blade while maintaining communication with said drive means such that the oscillating blade is driven in an oscillating motion relative to the stationary blade.

4. The cutting head according to claim 3 wherein the angular motion of said stationary blade is mechanically limited.

5. The cutting head according to claim 3 wherein said stationary blade has teeth of a first length and said oscillating blade has teeth of a second length where the first length exceeds the second length.

6. A cutting head for a hair cutter having a housing where the housing contains a motor therein, said cutting head comprising a pivoting blade mechanically attached to said housing such that the pivoting blade is freely movable over a limited range of angular motion relative to the motorized housing while cutting; and an oscillating blade in communication with the motor to drive the oscillating blade in an oscillating motion relative to the pivoting blade and connected to the pivoting blade such that the angular motion of the pivoting blade causes angular motion of the oscillating blade in direct proportion to the angular motion of the pivoting blade.

7. A power-driven hair cutter comprising an elongate housing having a longitudinal axis and containing motor means for generating a drive force communicated through a drive peg;

a cutting head removably and replacably attachable to a front end of said elongate housing such that the cutting head is free to pivot relative to the elongate housing while cutting, said cutting head comprising a stationary blade having a concave array of teeth;

a reciprocating blade having a concave array of teeth and in mechanical communication with said drive peg to reciprocate in shearing engagement with said stationary blade, said blades being cooperative with one another to define a main cutting edge arranged along the front end of the housing.

8. The cutting head according to claim 7 wherein said pivoting blade and said oscillating blade have non-linear cutting edges.

9. The cutting head according to claim 8 wherein said pivoting blade and said oscillating blade have a longitudinal axis and are concave with respect to said longitudinal axis.

10. The cutting head according to claim 8 wherein said pivoting blade and said oscillating blade have a vertical axis and are convex with respect to said vertical axis.

11. The apparatus according to claim 10 wherein the angular motion of said stationary blade is mechanically limited.

12. The power-driven hair cutter according to claim 10 wherein said stationary blade has teeth of a first length and said oscillating blade has teeth of a second length where the first length exceeds the second length.

* * * * *